United States Patent [19]

Neumann et al.

[11] Patent Number: 4,572,606

[45] Date of Patent: Feb. 25, 1986

[54] PROCESS FOR PRODUCING CONTACT-SPRING BUSHES AND A SPRING CONTACT BUSH

[75] Inventors: Bernhard Neumann, Waldkraiburg; Rainer Ramisch, Mühldorf, both of Fed. Rep. of Germany

[73] Assignee: Otto Dunkel GmbH Fabrik für Elektrotechnische Gerate, Mühldorf, Fed. Rep. of Germany

[21] Appl. No.: 674,138

[22] Filed: Nov. 23, 1984

[30] Foreign Application Priority Data

Nov. 25, 1983 [DE] Fed. Rep. of Germany ..... 3342742

[51] Int. Cl.[4] ..... H01R 11/22; H01R 43/04

[52] U.S. Cl. ..... 339/262 R; 29/882; 339/256 R

[58] Field of Search ..... 29/882, 876; 339/256 R, 339/262 R, 273 R, 262 F, 262 RR

[56] References Cited

U.S. PATENT DOCUMENTS 3,023,789 3/1962 Bonhomme .
3,107,966 10/1963 Bonhomme .
3,120,989 2/1964 Solorow et al.
3,141,723 7/1964 Bonhomme .
3,181,112 4/1965 Bonhomme .
3,470,527 9/1969 Bonhomme .
3,557,428 1/1971 Bonhomme .
3,858,962 1/1975 Bonhomme .

FOREIGN PATENT DOCUMENTS 669220 12/1938 Fed. Rep. of Germany .
1082957 6/1960 Fed. Rep. of Germany .
1415491 10/1968 Fed. Rep. of Germany .
1590124 3/1970 Fed. Rep. of Germany .
2558003 6/1977 Fed. Rep. of Germany .

*Primary Examiner*—Howard N. Goldberg
*Assistant Examiner*—Carl J. Arbes
*Attorney, Agent, or Firm*—Holman & Stern

[57] ABSTRACT

A process for the production of contact-spring bushes with a plurality of contact springs curved radially inwardly and clamped on one end in an approximately cylindrical bush body. Initially straight contact springs formed by portions of a contact-spring wire are first introduced into the interior of the bush body and are subsequently, on the one hand, pressed against an annular extension partially projecting into the bush body and located at the front end of a line connection piece and fixed in this position on one end and, on the other hand, elastically deformed radially, in such a way that their other ends facing the pin insertion end of the bush body are guided so as to be freely movable in an annular gap provided between the bush body and an annular body provided in it. Contact-spring bushes of particularly small dimensions can be produced in a simple way when, after the contact springs have been introduced into the bush body which is formed by a thin-walled deformable sleeve, the bush body is provided from the outside, at each of two locations offset axially in relation to each other and the ends of the bush body with an annular bead projecting radially inwards, these engaging the contact springs and providing them with the curvature directed radially inwards.

14 Claims, 9 Drawing Figures

PROCESS FOR PRODUCING CONTACT-SPRING BUSHES AND A SPRING CONTACT BUSH

BACKGROUND OF THE INVENTION

This invention relates to the production of contact-spring bushes with a plurality of contact springs curved radially inwards and clamped on one side both in a substantially cylindrical bush body by a process wherein the initially straight contact springs formed by portions of a contact-spring wire are first introduced into the interior of the bush body aligned with one another and are subsequently, on the one hand, pressed against an annular extension partially projecting into the bush body and located at the front end of a line connection piece and fixed in this position on one side and, on the other hand, elastically deformed radially, in such a way that their other ends facing the pin insertion end of the bush body are guided so as to be freely movable in an annular gap provided between the bush body and an annular body provided in the latter.

DESCRIPTION OF THE PRIOR ART

For many years, and occasionally even at the present time, production of such contact-spring bushes has been carried out with contact springs which are bent forwardly on one side and which are introduced individually into the bush body by hand. A technique disclosed in German Offenlegungsschrift No. 1,415,491 does away with the above-mentioned manual assembly and aims to achieve automation, but has proven to be disadvantageous because the bush body has to be formed as a lathe-turned part in order to provide in the bush interior, as a result of different inside diameters, supporting edges against which the contact springs come to rest when they are bent radially from the inside outwardly. In addition to the high production costs of a lathe-turned part using this technique, another undesirable feature is that only contact-spring bushes for contact pins from approximately 1 mm upwardly can be produced. For a contact pin with a diameter of 0.75 mm, it would only be possible to produce a bush with a diameter of at least 2.25 mm. However, according to present requirements, the bush body should have a diameter of only approximately 1.5 mm.

In another known production process of a different type referred to in U.S. Pat. No. 3,023,789, the contact springs are arranged in a rigid bush along generating lines of a hyperboloid of revolution and are pressed firmly by means of their two bent-round ends against the end face of the bush. Although contact-spring bushes produced according to this process have the favorable dimensional conditions required, which would allow the desired miniature design to be achieved, nevertheless this technique suffers from disadvantages because the spring ends cannot be treated by electroplating, very narrow tolerances have to be maintained between the pin and bush, and particularly because of an unfavorable spring characteristic, with only a relatively few contact springs being possible, thus placing limits on current transmission.

SUMMARY OF THE INVENTION

A basic object of this invention is to provide for the production of contact-spring bushes which is simpler in production terms, which is capable of manufacturing contact-spring bushes in a miniature design, that is to say with a relatively small outside diameter suitable for contact pins with a diameter equal to or less than, for example, 0.6 mm, but which contact-spring bushes are nevertheless characterized by a high current-carrying capacity and a long life.

According to the preferred process of this invention, these foregoing objects are achieved because, after the contact springs have been introduced into the bush body which is formed by a thin-walled deformable sleeve, the bush body is provided from the outside, at at least each of two locations offset axially in relation to the annular body or the annular extension and arranged at a distance from one another, with an annular bead projecting radially inwardly, these beads engaging the contact springs and providing them with a curvature directed radially inwards.

In the process of this invention it is possible to use sleeves which form the bush body and are prefabricated economically as drawn parts, and which have a wall thickness of, on the order of, 0.1 mm and which can easily be deformed from outside to form the annular beads. According to the process of the invention, bushes intended for contact pins with a diameter of approximately 1.5 mm can be produced. Consequently an unusually large number of contact-spring bushes produced by the process according to the invention can be arranged next to one another in the most confined space, and thus multi-contact connectors of high quality can be provided at moderate cost.

To ensure that contact is made perfectly as a result of a sufficient curvature of the contact springs, it has proved advantageous, in a further embodiment of the process according to the invention, to provide the bush body in the region of each annular bead with an inside diameter which is less than the outside diameter of the annular body supporting the free ends of the contact springs, plug double the diameter of the contact springs.

In a further embodiment, the peripheral region of the bush body between the two annular grooves located at a distance from one another can be provided with the same reduction in diameter with which the annular grooves themselves are formed. This, therefore, results in a middle bush-body portion with a continuous constant reduction in diameter, the two ends of this portion providing shoulders which ensure the radially elastic deformation of the contact springs.

It has proved particularly expedient to form the annular grooves in the bush body as a result of indentation by means of rollers rotating relative to the bush body about the axis of the latter. At the same time, the rollers can be part of a device which causes them to revolve around the stationary bush body. Alternatively, it is possible to mount the rollers so that they are stationary and to cause the bush body to rotate relative to them.

In a particularly desirable manner, the process of this invention provides an annular body which, in the assembled state, supports the contact-spring ends and the inside diameter of which is larger than the smallest diameter in the middle of the bush between the curved contact springs each lying in an axial plane of the bush, but less than the pin insertion orifice provided in the bush body, and the outside diameter of which is less than the inside diameter of the bush body, introduced loosely into the bush body and, after assembly, retained by the contact-spring ends resting against it. Contact-spring bushes produced according to this process have the advantage that, when the contact-spring bushes are used, the loosely introduced ring not only guarantees the free movability of the spring on one side, but also compensates for dimensional variations, that is to say, guarantees centering between the plug pin and the contact-spring bush.

At the same time, it has proved very favorable to provide an annular body which, on its side facing the contact-pin insertion orifice of the contact-spring bush, has a flange of larger diameter which correspondingly enlarges the bearing surface, but the outside diameter of which is less than the inside diameter of the contact-spring bush.

Further details, advantages and features of the invention emerge from the following description and the drawing, to which express reference is made as regards all details not described in the text and in which:

DETAILED DESCRIPTION OF THE PREFERRED EMBODIMENTS

Figure 1:
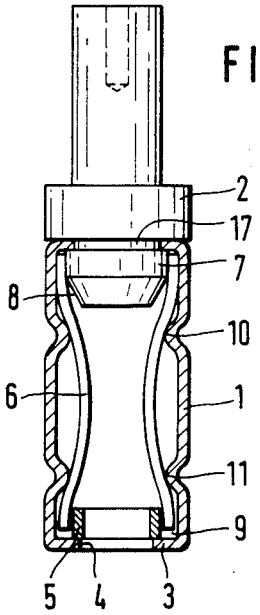
FIG. 1 is a view, partly in cross-section and partly in elevation for illustrative convenience of one embodiment of contact-spring bush produced by the process of the instant invention.

Like reference numerals refer to like parts in the several views.

Figure 2:
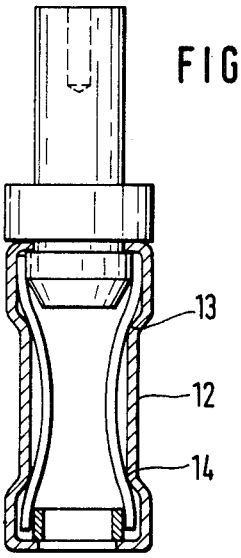
FIG. 2 is a view similar to FIG. 1 of a modified contact-spring bush according to the instant invention.

As is evident from the drawings, a contact-spring bush is illustrated in FIGS. 1 and 2 and comprises a substantially cylindrical bush body 1 in the form of a thin-walled deformable sleeve. This bush body 1 is connected at one end to a line connection piece 2. At the opposite end, the bush body 1 has an inwardly extending crimped portion or annular flange 3 defining a central pin insertion orifice 4. In the region of this pin insertion orifice 4, an annular body 5 is provided on the flange 3, its inside diameter being somewhat less than the diameter of the pin insertion orifice 4. A plurality of contact springs 6 is arranged distributed on the inner periphery of the bush body 1. These contact springs 6 are fixed or secured on one end between an annular extension 7 which projects into the bush body 1 and belongs to the line connection piece 2 and which terminates on the end face in a truncated cone, and the inside surface of the end of the bush body 1 facing the line connection piece 2. The other ends of the contact springs 6 facing the pin insertion end of the bush body 1 are guided so as to be freely movable in an annular gap 9 defined between the bush body 1 and the annular body 5.

The curvature of the contact springs 6 in the embodiment of FIG. 1 which is directed radially inwards, is achieved because the bush body 1 is provided from outside, at at least each of two locations offset axially in relation to each other and to the annular body 5 and the annular extension 7, with an annular bead 10 or 11 which projects radially inwardly and which rests against the contact springs and deforms them elastically radially inwards. The bush body 1 is provided, in the region of each annular bead 10 or 11, with an inside diameter which is less than the outside diameter of the annular body 5 supporting the free ends of the contact springs 6, plug double the diameter of the contact springs 6.

The embodiment of FIG. 2 differs from that of FIG. 1 in that the peripheral region 12 of the bush body 1 between the equivalent of the two annular grooves located at a distance from one another in FIG. 1 is provided with the same reduction in diameter as the annular grooves themselves. In this way, in this design, the shoulders 13 and 14 limiting the peripheral region 12 perform the function of the annular beads 10 and 11, respectively, of the embodiment of FIG. 1.

Figure 3:
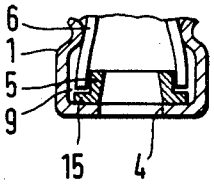
FIG. 3 is a fragmentary view of a further modification of a counter-spring bush produced according to the instant invention concepts.

It will be seen from the modification of FIG. 3 that the annular body 5 is provided, on its side facing the contact-pin insertion orifice 4 of the contact-spring bush 1, with a flange 15 of larger diameter which correspondingly enlarges the bearing surface, but the outside diameter of which is less than the inside diameter of the contact-spring bush 1.

As is evident from FIGS. 1 and 2, the inside diameter of the annular body 5 is selected larger than the smallest diameter distance in the middle of the bush between the curved contact springs 6 and each lying in an axial plane of the bush. The annular body, introduced loosely before the contact springs 6 are positioned in the bush body 1, is retained after assembly by the contact-spring ends resting against it. Because of the dimensional relations mentioned above, perfect contact-making is guaranteed even if a contact pin were to be inserted slightly offset axially into the contact-spring bush. The annular body 5 can then move aside together with the contact-spring ends resting against it. If this feature is not necessary, the annular body 5 can be integrally formed with the bush body 1.

Figure 4:
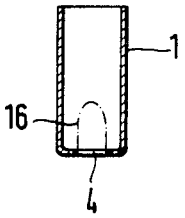
FIGS. 4 to 9 show in a highly diagrammatic way the production steps of the process of the instant invention.
Figure 5:
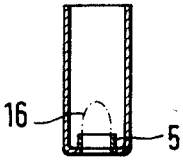

FIGS. 4 to 9 illustrate diagrammatically the steps of the production process according to the invention. Initially, as seen in FIG. 4, a bush body 1 is prepared, specifically with the introduction of a mandrel 16 which passes through the pin insertion orifice 4. Subsequently, as shown in FIG. 5, the annular body 5 is introduced into the bush body 1, specifically in such a way that it surrounds the mandrel 16. In this diagrammatic representation, an annular body 5 of the type shown in FIGS. 1 and 2 is shown. Alternatively, an annular body 6 with a flange 15 as shown in FIG. 3 could be used.

Figure 6:
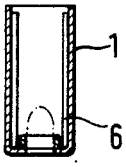
Figure 7:
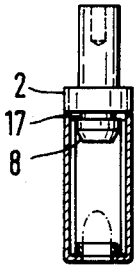

In a further step illustrated in FIG. 6, the contact springs 6 are introduced into the bush body 1 by means of conventional feed devices not shown in detail. Then, as seen in FIG. 7, the contact springs 1 are temporarily secured in their introduced position because the line connection piece 2, together with its annular extension 7, is introduced into the space defined by the upper ends of the contact springs 6, this being facilitated by the truncated cone 8 on the annular extension 7. As also indicated in this figure, there is, at the rear end of the annular extension 7, an annular groove 17, to which the top edge of the bush body 1 extends.

Figure 8:
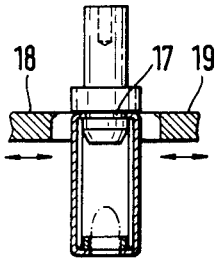
Figure 9:
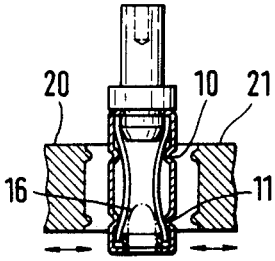

In the following process step illustrated in FIG. 8, the top edge of the bush body 1 is crimped into the annular groove 17 by rollers 18 and 19, which rotate relative to the bush body 1 about the axis of the latter and are mounted so as to be movable towards the bush body 1 in the direction of the arrow and which can be pressed against the bush body in a well known manner. During the last process step according to FIG. 9, the annular beads 10 and 11 are formed in a similar way as a result of indentation by means of rollers 20 and 21 rotating relative to the bush body 1 about the axis of the latter, and the contact springs 6 acquire the inwardly-directed curvature shown particularly in FIGS. 1 and 2. After the mandrel 16 has been removed, the contact-spring bushd is completed, and the prescribed operational tests can be carried out.

We claim:

1. A process for producing contact-spring bushes comprising:

(a) providing a substantially cylindrical, thin-walled, deformable bush body having spaced first and second end portions, said first end portion being partially closed by an inwardly extending annular flange portion which substantially centrally defines a contact-pin insertion orifice;

(b) providing an annular body internally of said bush body on said inwardly extending flange portion, said annular body having an outside diameter smaller than the inside diameter of said bush body to define an annular gap therebetween, and an inside diameter smaller than said contact-pin insertion orifice;

(c) positioning a plurality of aligned straight contact springs into said bush body, said springs having first and second ends, said first ends being positioned in said annular gap;

(d) partially inserting an annular extension of a line connection member into said second end portion of said bush body so as to fix said second ends of said contact springs between the inside surface of said second end portion of said bush body and the outside surface of said annular extension, with said first ends of said contact springs freely movable in said annular gap; and (e) deformingly pressing said bush body from the outside to define at least two annular beads projecting radially inwards, said beads being spaced axially from each other and spaced axially from said first and second end portions of said bush body and engaging said contact springs to provide them with a radially inwardly curved configuration intermediate their first and second ends.

2. The process of claim 1 wherein said bush body is provided in the region of said beads with an inside diameter which is less than the outside diameter of said annular body plus twice the diameter of said contact springs.

3. The process of claim 2 wherein the region of said bush body between said beads is deformably pressed to provide said region with the same inside diameter as said beads.

4. The process of claim 1 wherein said beads are formed by indenting said bush body by means of rollers rotating relative to said bush body about the axis of said bush body.

5. The process of claim 1 wherein said contact springs are sufficiently curved by said deformation such that the smallest space between respective contact springs at their inwardly curved central portions is less than the diameter of said contact-pin insertion orifice.

6. The process of claim 1 wherein said annular body is introduced loosely into said bush body before said contact springs are introduced, and is retained in position, after assembly, by said first ends of said contact springs resting against it.

7. The process of claim 6 wherein said annular body is provided, on the side facing said inwardly extending flange of said bush body with an outwardly extending flange portion to enlarge the bearing surface, the outside diameter of said outwardly extending flange portion of said annular body being less than the inside diameter of said first end portion of said bush body.

8. A contact-spring bush produced by the process of claim 1.

9. A contact-spring bush comprising:

a line connection piece with an annular projecting head;

an approximately cylindrical bush body formed by a thin-walled deformable sleeve having at one end an opening formed to receive the line connection piece inside the sleeve and grip it, having at its other end an entry port for a pin, and the sleeve having at least two intermediate regions spaced apart along the length of the bush of reduced internal diameter compared to its internal diameter at its ends;

an annular wall inside the bush body adjacent the entry port for the pin and having an external diameter greater than that of the entry port; and a plurality of contact springs, each having one end jammed between the head and the sleeve and the other end located in the annular gap between the annular wall and the sleeve, with the springs being bowed elastically inwards towards the central axis of the sleeve by contact with the two intermediate regions of reduced diameter.

10. A contact-spring bush according to claim 9 wherein the annular wall is integral with the bush body.

11. A contact-spring bush according to claim 9 wherein the annular wall is formed on an insert separate from the bush body.

12. A contact-spring bush according to claim 11 wherein the inside diameter of the annular insert is selected larger than the smallest distance in the middle of the bush between the curved contact springs each lying in an axial plane of the bush, but less than the diameter of the pin port provided in the bush body.

13. A contact-spring bush according to claim 9 wherein the bush body at the reduced diameter regions has an inside diameter which is less than the outside diameter of the annular wall, plus double the diameter of the contact springs.

14. A contact-spring bush according to claim 9 wherein the central region of the bush body is of uniformly reduced diameter, with shoulders at the ends of said regions causing the bowing of the contact springs.

* * * * *